United States Patent [19]

Severson

[11] 3,967,327

[45] July 6, 1976

[54] FOLDABLE BED

[76] Inventor: Harvey M. Severson, 8418 Dupont Ave. South, Minneapolis, Minn. 55420

[22] Filed: Feb. 10, 1975

[21] Appl. No.: 548,687

[52] U.S. Cl. ..... 5/9 B; 5/8; 5/114; 108/111; 182/140; 182/152; 211/149; 211/195

[51] Int. Cl.[2] ..... A47K 4/00; A47K 11/00

[58] Field of Search ..... 5/9 B, 9 R, 8, 82, 85, 5/114, 174; 108/111; 211/178, 149; 182/82, 140, 152

[56] References Cited

UNITED STATES PATENTS

| | | | |
|---|---|---|---|
| 1,001,946 | 8/1911 | Gumm | 5/9 R |
| 1,359,637 | 11/1920 | Travis et al. | 5/9 R |
| 1,561,797 | 11/1925 | Rumpel | 5/9 R X |
| 1,802,149 | 4/1931 | Holt | 211/178 R X |
| 2,354,906 | 8/1944 | Bailey et al. | 182/152 X |
| 2,744,794 | 5/1956 | Sheard | 182/152 |
| 2,901,124 | 8/1959 | Gingher et al. | 108/111 X |
| 3,463,265 | 8/1969 | Clover | 182/152 X |

FOREIGN PATENTS OR APPLICATIONS

| | | | |
|---|---|---|---|
| 341,355 | 12/1936 | Italy | 5/8 |
| 189,916 | 6/1964 | Sweden | 5/82 |
| 109,832 | 3/1917 | United Kingdom | 211/178 R |

*Primary Examiner*—Paul R. Gilliam
*Assistant Examiner*—Carl F. Pietruszka
*Attorney, Agent, or Firm*—Merchant, Gould, Smith, Edell, Welter & Schmidt

[57] ABSTRACT

An elongated, normally horizontally disposed, generally rectangular base frame supported adjacent its opposite ends by pairs of legs, and a pair of end frames each having a pair of spaced parallel posts connected adjacent one end by a cross-member and pivotally connected at their other ends to the legs at one end of the base frame for movements between operative generally vertical positions and folded generally horizontal positions overlying the base frame. An elongated top frame is detachably mounted to the end frames adjacent the cross members and, like the base frame, is provided with a body supporting sheet. An intermediate frame, similar to the top frame, is detachably mounted between the end frames, and top and intermediate frames being adapted to be horizontally disposed and held in stacked relationship between the base frame and the end frames in their folded positions.

5 Claims, 7 Drawing Figures

FIG. 3
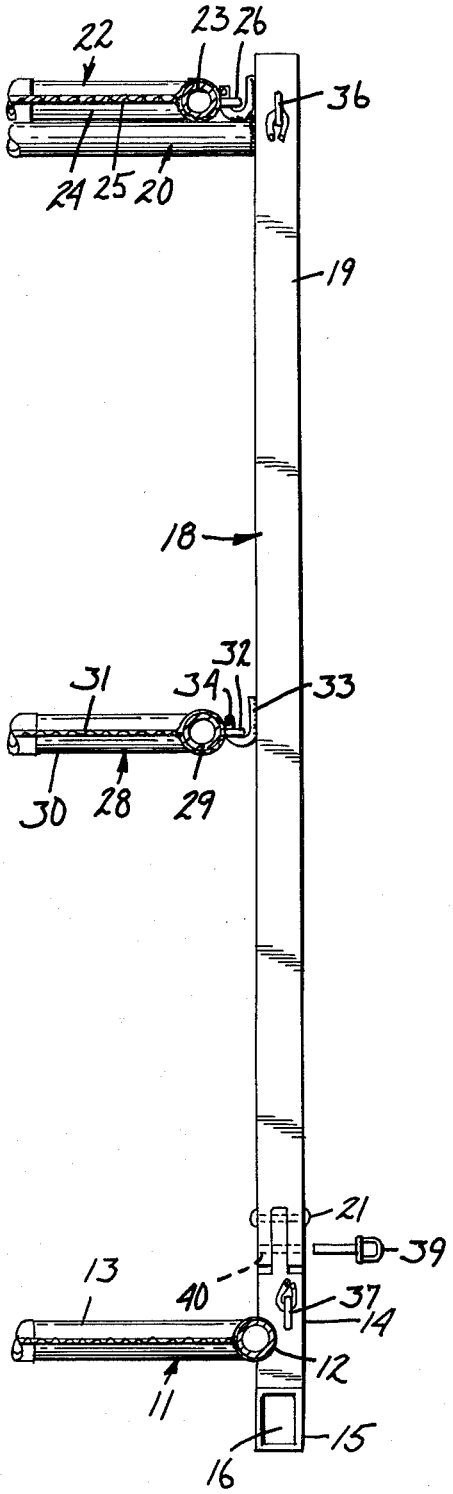
FIG. 4
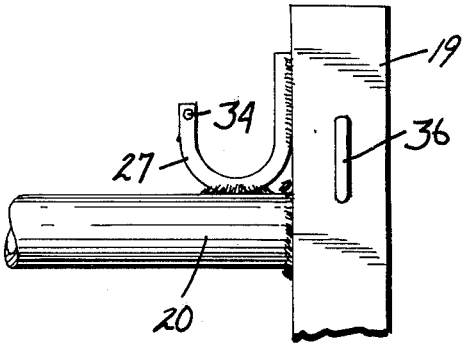
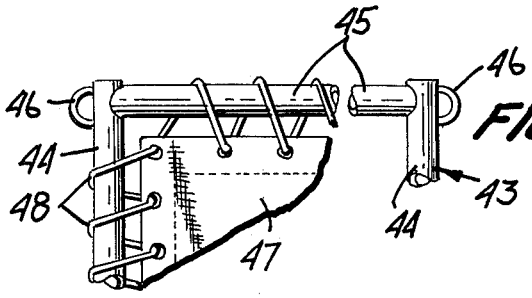
FIG. 5
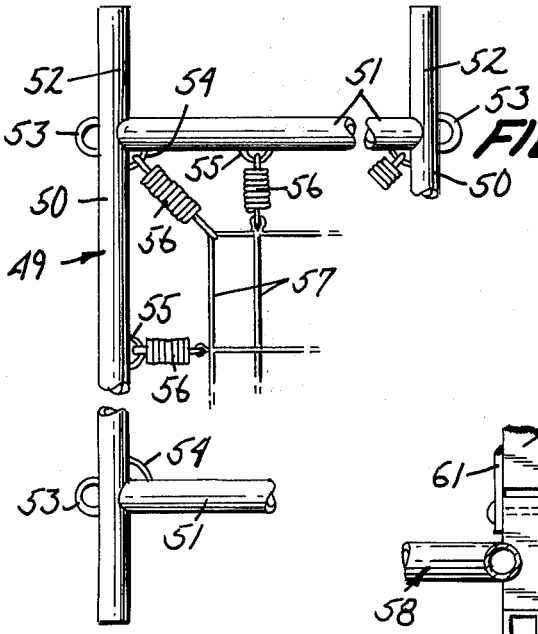
FIG. 6
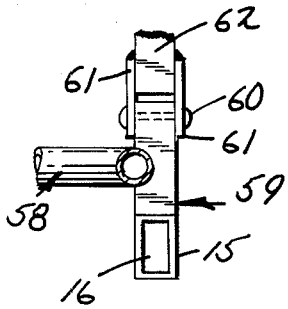
FIG. 7

FOLDABLE BED

This invention relates to bed or cot structures and more particularly to such structures wherein a plurality of cots in a foldable supporting structure are arranged in a vertical series for use, and disposed in overlying engagement within the supporting structure in a folded condition, so as to occupy a minimum of space for easy transportation and convenient storage.

SUMMARY OF THE INVENTION

The foldable bed of this invention involves a normally horizontal generally rectangular base frame having a pair of supporting legs adjacent each of its opposite ends, and a pair of end frames each at an opposite end of the base frame. The end frames each include a pair of laterally spaced parallel posts and a cross member secured at its opposite ends to the posts adjacent one end thereof. Pivot means pivotally connect the posts of each end frame at their other ends to different ones of the legs at a respective end of the base frame, on aligned horizontal axes extending transversely of the base frame, for swinging movements of the end frames between folded inoperative horizontal positions upwardly spaced from the base frame and upright operative positions. The bed further includes an elongated generally rectangular top frame and means including the cross members for detachably securing the top frame to the end frames against lateral and longitudinal movement therebetween. Brace means is provided to hold the end frames in their operative positions, and the base and top frames are provided with individual body supporting means.

DESCRIPTION OF THE DRAWINGS

FIG. 3 is an enlarged fragmentary vertical section taken generally on the line 3—3 of FIG. 1;

FIG. 4 is a further enlarged fragmentary view corresponding to a portion of FIG. 3, some parts being removed;

FIGS. 5 and 6 are fragmentary views in top plan, showing modified bed or cot arrangements; and FIG. 7 is a fragmentary view corresponding to a portion of FIG. 3 but showing a further modified construction.

DETAILED DESCRIPTION OF THE PREFERRED EMBODIMENT

Figure 1:
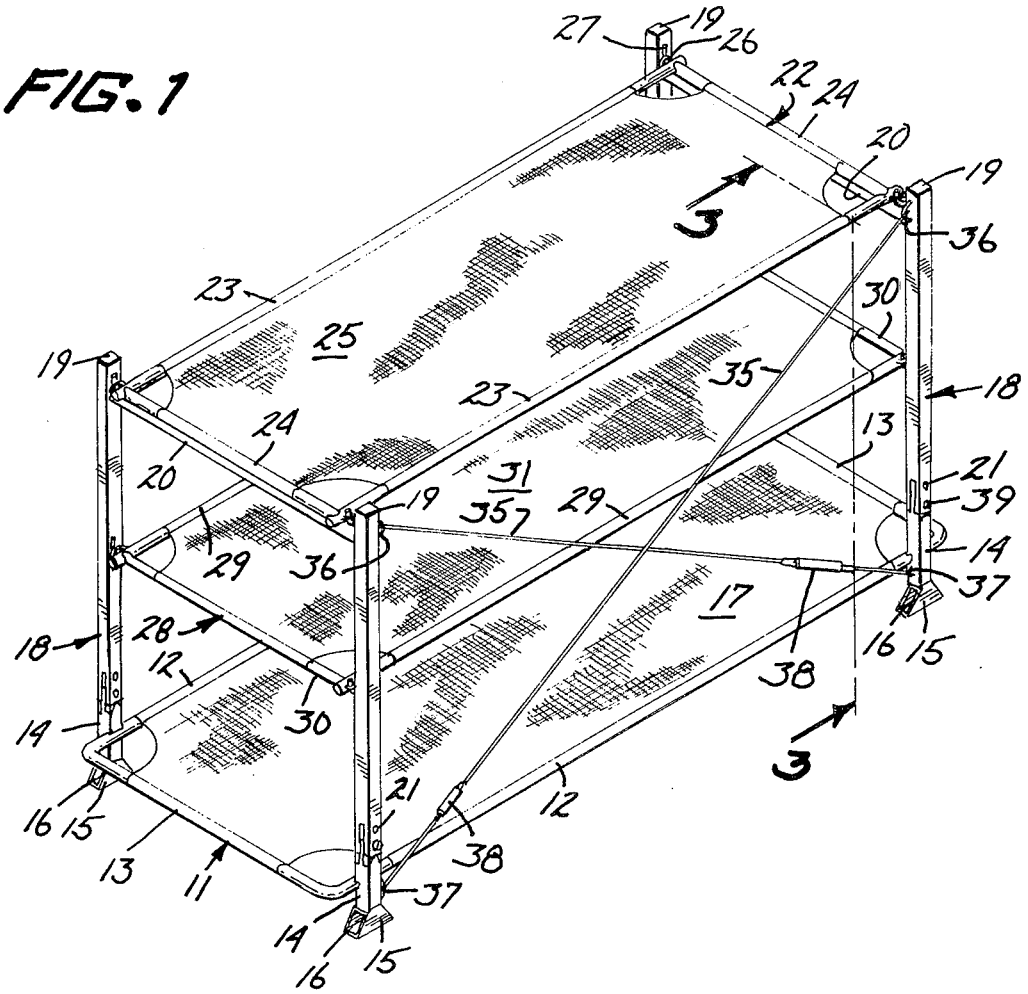
FIG. 1 is a view in perspective of a fold-up or folding bed of this invention in its unfolded operative position.

In the embodiment of the invention illustrated in FIGS. 1–4, an elongated generally rectangular base frame, indicated generally at 11, is shown as comprising a pair of laterally spaced parallel side rails 12 connected at their opposite ends by end rails 13. The base frame 11 is preferably made from metallic tubing and is welded or otherwise rigidly secured adjacent its opposite ends to pairs of supporting legs 14 having stirrup-like feet 15 at their lower ends, the feet 15 defining laterally opening recesses 16. The base frame 11 has sewn or otherwise rigidly secured thereto a sheet 17 of canvas of other suitable material to provide a cot.

Figure 2:
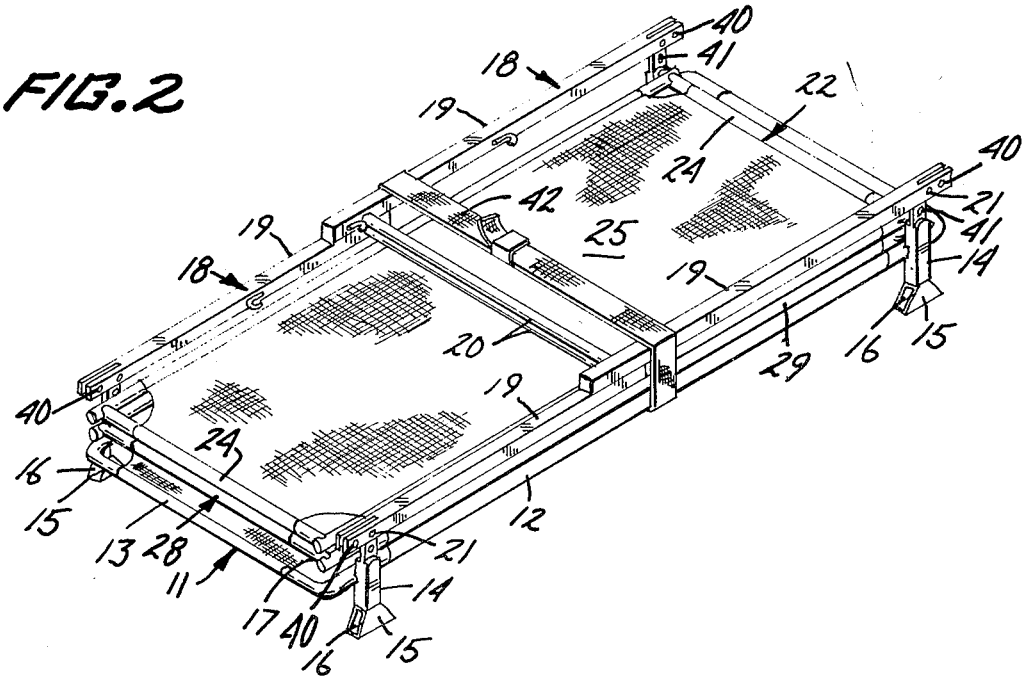
FIG. 2 is a view in perspective of the bed of this invention in its inoperative folded state.

A pair of end frames 18 are disposed adjacent an opposite end of the base frame 11, each end frame 18 comprising a pair of laterally spaced parallel posts 19 and a cross member 20, each cross member 20 being welded or otherwise rigidly secured at its opposite ends to its respective posts 19 adjacent one end thereof. At their opposite ends, the posts 19 of each end frame 18 are pivotally secured to respective legs 14 by pivot pins or the like 21. The pivot pins 21 of each end frame 18 are disposed on aligned horizontal axes extending transversely of the base frame 11, so that each end frame 18 may be pivotally moved between vertically disposed operative positions shown in FIG. 1 and inoperative folded positions as shown in FIG. 2. In their inoperative positions, the end frames 18 are disposed in closely spaced overlying relationship to the base frame 11.

An elongated rectangular frame 22, like the base frame 11, includes a pair of laterally parallel side rails 23 connected at their opposite ends by cross members 24. A sheet 25 of canvas or other suitable material is sewn or otherwise secured to the side rails 23 and cross members 24 to provide a cot for supporting the body of a person. The top frame 22 is adapted to rest on the cross members 20 of the end frames 18 between the upper end portions of the posts 19. The top frame 22 is held against movements transversely and longitudinally of the bed structure by loops or eyes 26 that project laterally outwardly of the end portions of the side rails 23 and which receive upwardly opening hooks 27 that are welded to the upper end portions of the end frame posts 19.

An intermediate frame 28 is substantially identical to the top frame 22, having elongated side rails 29 connected at their opposite end portions by cross members 30, the intermediate frame 28 having secured thereto a sheet 31 of canvas or other suitable material to provide an intermediate cot. Like the side rails 23, the side rails 29 are provided with loops or eyes 32 for reception of upturned hooks 33 secured to the posts 19 generally centrally between the cross members 20 and the base frame 11. With reference to FIGS. 3 and 4, it will be seen that the hooks 27 and 33 are provided with lateral openings 34 through which locking pins or the like, not shown, may be inserted to prevent accidental disengagement of the frames 22 and 28 from the posts 19. A pair of brace members 35 in the form of rods or cables are secured each to the upper end of one of the posts 19 of a different end frame 18, as indicated at 36 in FIGS. 1 and 3. At their other ends, each brace member 35 is secured to a leg 14 at the opposite end of the bed structure, as indicated at 37 in FIGS. 1 and 3, the arrangement being such that the brace members are diagonally disposed in opposite directions at one side of the bed structure, leaving the opposite side thereof open for easy access to the lower and intermediate cots. Each of the brace members 35 is preferably provided with conventional turnbuckles or the like 38 for adjusting the tension thereof.

While the cot frames 22 and 28 and brace members 35 are effective in holding the end frames 18 in their vertically disposed operative positions, I provide further means in the nature of a plurality of locking pins 39, one for each leg 14 and its respective post 19. The lower end portion of each post 19 is provided with a transverse opening 40 that is movable into alignment with a transverse opening 41 in its respective leg 14, the aligned openings 40 and 41 receiving a respective one of the locking pins 39. The locking pins are particularly useful in holding the end frames 18 in their operative vertical positions when the bed structure is being set up, prior to placing of the frames 22 and 28 on their respective supporting hooks 27 and 33.

When it is desired to fold the bed structure for shipment, storage or the like, it is only necessary to lift the frames 22 and 28 from engagement with their respective hooks 27 and 33, and deposit the same in superposed relationship on the base frame 11, as shown in FIG. 2, to provide a stack thereof. The locking pins 39 are then pulled from their respective openings 40 and 41, and the end frames 18 are folded downwardly into overlying engagement with the uppermost one of the frames 22 and 28, and into overlapping engagement of one end frame 18 with the other thereof. It will be appreciated that the vertical distance between the base frame 11 and the pivot pins 21 is such that the end frames 18 will be generally parallel to the stacked frames 11, 22, and 28, the cross member 20 of one of the frames 18 being disposed in overlying engagement with the uppermost one of the frames 11, 22 and 28. For the purpose of securing the bed structure in its folded position, I provide suitable means, such as a flexible strap or belt 42, see FIG. 2. When folding the bed structure, the brace members 35 may be placed between the superposed frames.

The foldable bed of this invention is particularly adapted for use in various situations, particularly when temporary bedding is required. In instances of disaster, the beds can be quickly and easily shipped to or near the scene and quickly set up to accomodate injured persons. Further, beds produced in accordance with this invention can be set up in trucks, aircraft or other means of transportation, for the purpose of evacuating injured persons, the beds being held against movement in vehicles by means of suitable hold-down brackets, not shown, but insertable into the recesses 16 of the feet 15.

MODIFIED FORMS

In FIG. 5, a modified cot structure is fragmentarily shown, this structure including a rectangular frame 43 which may be assumed to be identical to either frame 24 or 28, having side rails 44 and cooperating cross members 45, one cross member 45 being shown. The frame 43 is provided with pairs of loops or eyes 46, and a body supporting sheet 47 is mounted in the frame 43 by conventional lacing 48.

An elongated rectangular frame 49 is fragmentarily shown in FIG. 6, this frame being similar to the frames 22 and 28, having side rails 50 and cross members 51. In the frame 49, the side rails 50 extend longitudinally outwardly beyond the cross members 51 to provide handles 52, enabling the frame 49 to be used as a stretcher for carrying the injured to or from the bed structure. The side rails are provided with mounting loops or eyes 53, and other loops 54 and 55, the loops 54 and 55 being anchors for matress supporting springs 56 and cooperating wires or cables 57.

In the modified arrangement illustrated fragmentarily in FIG. 7, a base frame 58, which may be assumed to be identical to the base frame 11, is carried by legs 59, one of which is shown. Like the legs 14, the legs 59 are provided with feet 15 having recesses 16 therein. At their upper end portions, the legs 59 are provided with transverse openings for the reception of pivot pins 60 that extend through suitable openings in hinge plates 61 that straddle the upper end portions of the legs 59, and which are welded or otherwise rigidly secured to the lower ends of respective ones of end frame posts 62 similar to the end frame posts 19. In the bed structure of FIG. 7, the top and intermediate bed frames, not shown, cooperate with the brace members 35 to hold the end frames in their upright operative positions without the use of locking pins such as the pins 39.

While I have shown and described a commercial form of my foldable bed and several modified arrangements, it will be understood that the same is capable of further modification without departure from the spirit and scope of the invention, as defined in the claims.

What is claimed is:

1. A foldable bed comprising:

a. a horizontal generally rectangular base frame having a pair of support legs adjacent each of the ends thereof;

b. a pair of end frames each disposed at an opposite end of said base frame, each end frame including a pair of laterally spaced parallel posts and a cross member secured at its opposite ends to said posts adjacent one end of the posts;

c. means pivotally connecting the posts of each end frame at their other ends to different ones of said legs at a respective end of said base frame on aligned horizontal axes extending transversely of the base frame for swinging movements of said end frames between folded inoperative horizontal positions in upwardly spaced relation to said base frame and vertically disposed operative positions;

d. an elongated generally rectangular top frame disposed laterally between the posts of said end frames and adapted to be moved between an operative position overlying said cross members and an inoperative position closely overlying said base frame whereby, when said top frame is moved to its inoperative position, said end frames will be disposed in overlying relation to said top frame when moved to their folded inoperative positions;

e. mounting means including said cross members, hooks and hook-receiving loops on respective ones of said posts and top frame, detachably securing said top frame to said end frames against relative longitudinal and lateral movements therebetween;

f. brace means between said base frame and said end frames in said operative positions of the end frames;

g. and individual body supporting means carried by said base and top frames.

2. The foldable bed defined in claim 1, in further combination with an intermediate rectangular frame generally similar to said top frame, support means comprising a plurality of hooks and cooperating hook receiving loops on respective ones of said intermediate frame and said posts detachably securing said intermediate frame to said end frames in an operative position intermediate said top and base frames, and body supporting means on said intermediate frame.

3. The foldable bed defined in claim 2, in which said top and intermediate frames are disposed laterally inwardly of the posts of said end frames and movable into horizontally disposed stacked relationship on said base frame when detached from said end frames, the pivotal connections of said posts to said legs being upwardly spaced from said base frame and at an elevation wherein said end frames will be disposed in overlying engagement with the uppermost one of said rectangular frames when disposed in said stacked relationship.

4. The foldable bed defined in claim 2, in which said top and intermediate frames include pairs of handle members at each of the opposite ends of the top and intermediate frames.

5. The foldable bed defined in claim 4, in further combination with locking means for releasably locking each of said posts to its respective leg against pivotal movement relative thereto when said end frames are moved to said operative positions thereof, said locking means comprising locking pins, each of said legs and its respective post having openings therethrough and moved into alignment, when said end frames are moved to their operative positions, for reception of a respective one of said locking pins.

* * * * *